US006682369B1

(12) United States Patent
Korsunsky et al.

(10) Patent No.: US 6,682,369 B1
(45) Date of Patent: Jan. 27, 2004

(54) ELECTRICAL CONNECTOR HAVING RETENTION SYSTEM FOR PRECISELY MOUNTING PLURAL BOARDS THEREIN

(75) Inventors: Iosif R. Korsunsky, Harrisburg, PA (US); Timothy B. Billman, Dover, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/247,252

(22) Filed: Sep. 18, 2002

(51) Int. Cl.[7] ..... H01R 13/648
(52) U.S. Cl. ..... 439/608; 439/108
(58) Field of Search ..... 439/608, 108, 439/101, 79, 76.1, 701

(56) References Cited

U.S. PATENT DOCUMENTS 5,980,321 A 11/1999 Cohen et al.
5,993,259 A * 11/1999 Stokoe et al. ..... 439/608
6,083,047 A * 7/2000 Paagman ..... 439/608
6,146,202 A * 11/2000 Ramey et al. ..... 439/608
6,152,747 A 11/2000 McNamara
6,238,245 B1 * 5/2001 Stokoe et al. ..... 439/608
6,267,604 B1 7/2001 Mickievicz et al.
6,273,762 B1 * 8/2001 Regnier ..... 439/608
6,293,827 B1 9/2001 Stokoe
6,299,483 B1 * 10/2001 Cohen et al. ..... 439/608
6,299,484 B2 10/2001 Van Woensel

* cited by examiner

*Primary Examiner*—Gary Paumen
(74) *Attorney, Agent, or Firm*—Wei Te Chung

(57) ABSTRACT

An electrical connector (1) comprises a dielectric housing consisting of a first housing (10, 52) and a second housing (40, 51), a spacer (20) assembled at a bottom of the housing and a plurality of circuit boards (30). The housing defines a plurality of parallel channels (15) extending in a mating direction of the electrical connector. A plurality of bumps (106) extends downward from an upper wall of the housing in alignment with the channels for abutting against with an upper face of a corresponding circuit board. The spacer consists of a plurality of identical wafers (21) thereby each two adjacent wafers defining a slot (200) to receive a corresponding circuit board therein. Each wafer has a dielectric base (22), a plurality of terminals (23) attached on a first side of the dielectric base to electrically connect with a corresponding circuit board, and a grounding bus (24) mainly attached on an opposite second side of the dielectric base.

2 Claims, 12 Drawing Sheets

ELECTRICAL CONNECTOR HAVING RETENTION SYSTEM FOR PRECISELY MOUNTING PLURAL BOARDS THEREIN

CROSS-REFERENCE TO RELATED APPLICATION

This patent application is a Co-pending Application of patent application Ser. No. 10/154,318, entitled "HIGH DENSITY ELECTRICAL CONNECTOR" and filed on May 22, 2002, invented by Timothy Brain Billman, and assigned to the same assignee with this application.

BACKGROUND OF THE INVENTION

1. Field of the Invention

The present invention relates to an electrical connector, and particularly to an electrical connector having a retention system for facilitating retaining a plurality of printed circuit boards in the electrical connector.

2. Description of Related Art

It is well known to provide an electrical connector having a plurality of printed circuit boards therein to resolve the problem for transmitting electrical signals in a high-speed and high-density manner. However, though the plurality of printed circuit boards can improve the signal transmission in the high speed and high density manner, some problems still need to be overcome. Referring to U.S. Pat. No. 6,267,604, it discloses an electrical connector having a plurality of circuit boards (13) therein. The circuit boards are assembled between a front housing portion (20) and an organizer (30). Each of the circuit boards has a mating edge (42), and the organizer has a plurality of slots (33) which are spaced apart in correspondence with apertures (22) defined in the front housing portion. In assembly, the mounting edges of the circuit boards are received in respective slots, and the circuit boards extend through respective apertures, whereby the circuit boards are retained in the electrical connector.

However, with the ever-increasing miniaturization of electronic circuit, along with the consequent reduction in sizes of the connector, the slots often are difficult to meet the requirement to accurately position the printed circuit boards. Lacking such an accurate positioning, the mating edges (42) of the circuit boards (13) cannot properly engage with a complementary connector. Hence, an improvement to resolve the problem of the prior art is required.

SUMMARY OF THE INVENTION

Accordingly, an object of the present invention is to provide an electrical connector which can achieve a precise mounting of a plurality of circuit boards in the connector.

In order to achieve the object set forth above, an electrical connector comprises a dielectric housing, a spacer in a recess at bottom of the housing, a plurality of circuit boards and a fastening element covering back of the housing. The dielectric housing defines a plurality of ribs to form parallel channels extending in a mating direction of the electrical connector. A plurality of bumps extends downward from a bottom face of an upper wall of the housing into the channels, respectively. The spacer consists of a plurality of identical wafers. Each wafer has a dielectric base, a plurality of terminals attached on a first side of the dielectric base to electrically connect with a corresponding circuit board, and a grounding bus mainly attached on an opposite second side of the dielectric base, wherein the grounding bus has contacting legs extending in the second side of the dielectric base thereby forming free ends facing an adjacent grounding bus to retain the corresponding circuit board between the legs and the adjacent grounding bus. Each grounding bus has a plurality of supporting pads projecting substantially parallel to the upper wall of the housing. Each individual circuit board is received in a corresponding channel of the dielectric housing and between two adjacent wafers. Each individual circuit board is also disposed between a corresponding bump of the housing and the supporting pads of a corresponding grounding bus.

Other objects, advantages and novel features of the invention will become more apparent from the following detailed description when taken in conjunction with the accompanying drawings.

DETAILED DESCRIPTION OF THE INVENTION

Figure 1:
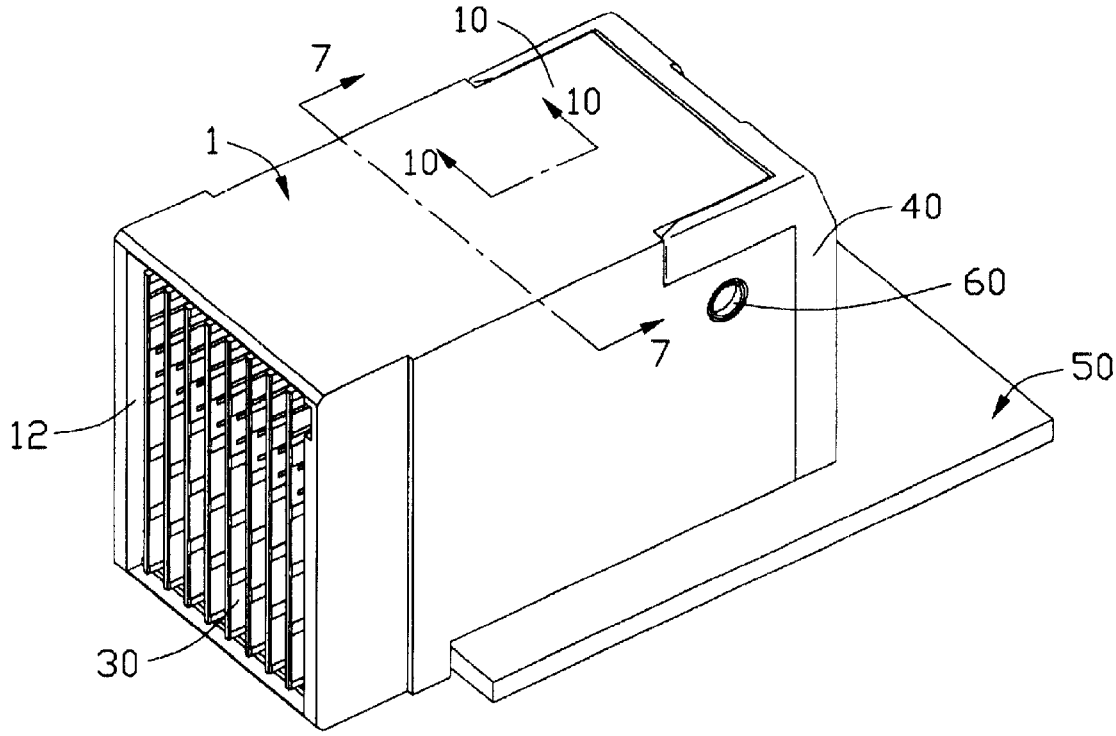
FIG. 1 is a top perspective view of an electrical connector in accordance with a first embodiment of the present invention, the connector being attached to a daughter board.
Figure 2:
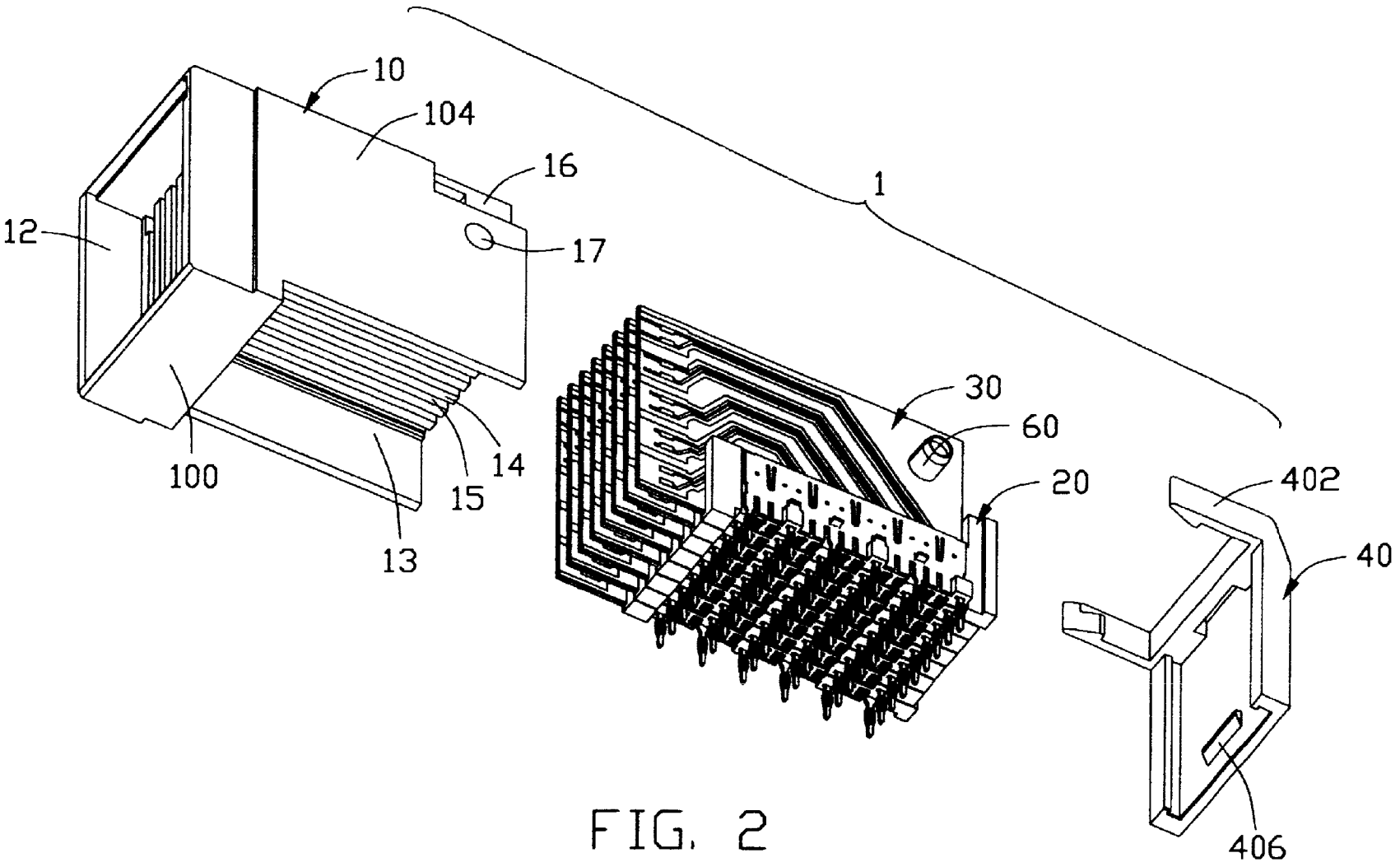
FIG. 2 is an exploded view of the electrical connector of FIG. 1, from a bottom aspect.
Figure 3:
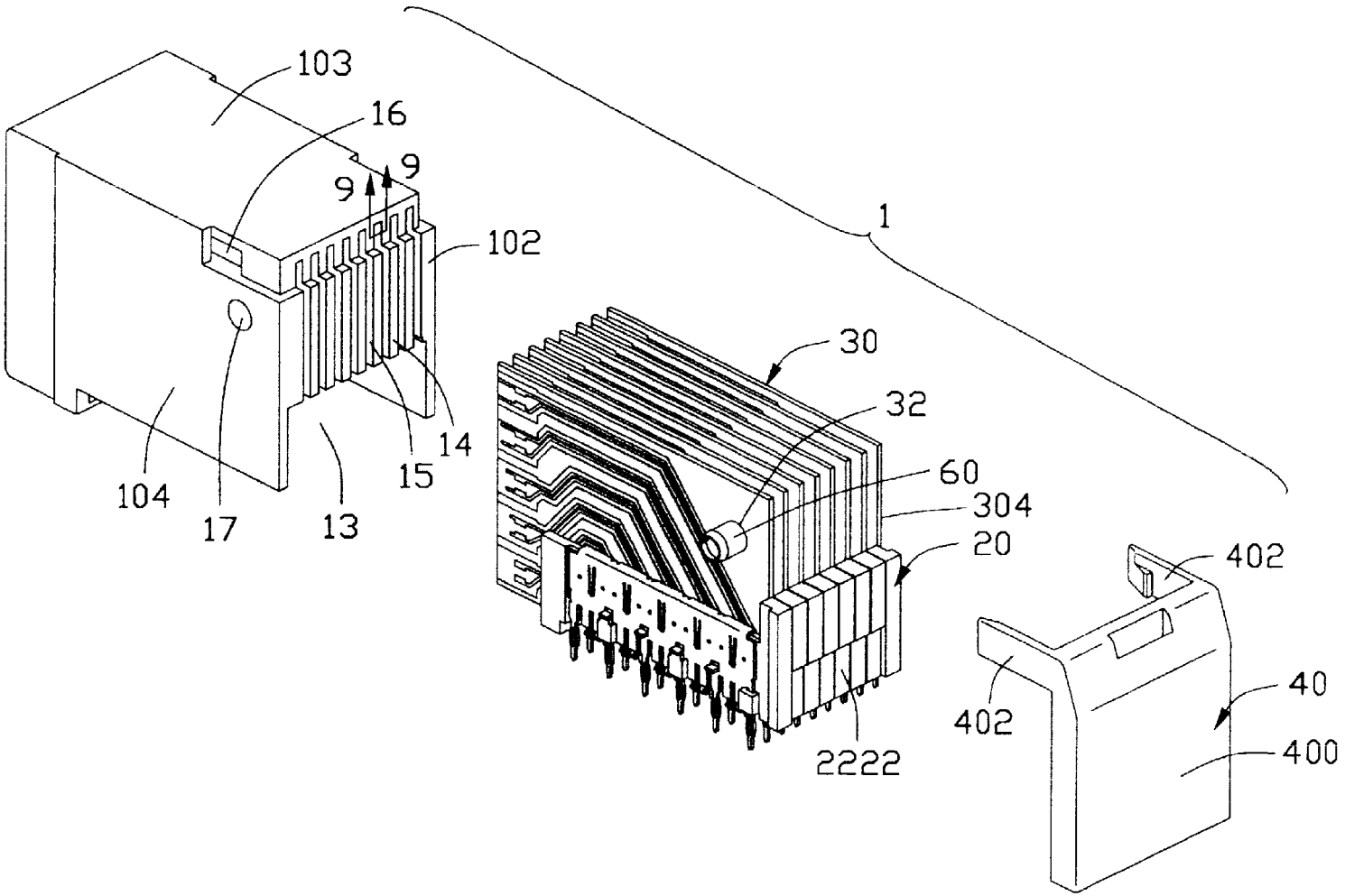
FIG. 3 is a view similar to FIG. 2 but from another aspect.

Referring to FIGS. 1–6, an electrical connector 1 in accordance with a first embodiment of the present invention comprises a dielectric housing 10, a spacer 20, a plurality of circuit boards 30 retained between the housing 10 and the spacer 20, and a fastening element 40 for securing the spacer 20 to the housing 10. The electrical connector 1 is for attachment to a daughter board 50. Each of the circuit boards 30 includes a dielectric substrate made of conventional circuit board substrate material, such as FR4, a plurality of conductive signal and grounding traces on one side of the substrate for providing electrical paths through the connector 1, and a layer of conductive material coated on an opposite side of the substrate for providing a grounding plane to the substrate.

The dielectric housing 10 is generally in a rectangular shape. The housing 10 defines a front mating port 12 through which a complementary connector (not shown) mates with the electrical connector 1. The connector 1 and the complementary connector serve to interconnect the daughter board 50 with a backplane (not shown) to which the complementary connector is attached. The housing 10 defines a bottom surface 100, a rear surface 102, a top surface 103, and a pair of opposite lateral surfaces 104. A recess 13 is defined from the bottom surface 100 to the top surface 103, and a plurality of parallel ribs 14 extending from the rear surface 102 to the front mating port 12 thereby forming parallel channels 15 each of which is in communication with the recess 13. The housing 10 defines a pair of grooves 16 in corners between the lateral surfaces 104 and the top surface 103. An aperture 17 is defined transversely through the opposite lateral surfaces 104 of the housing 10 near the rear surface 102.

Figure 4:
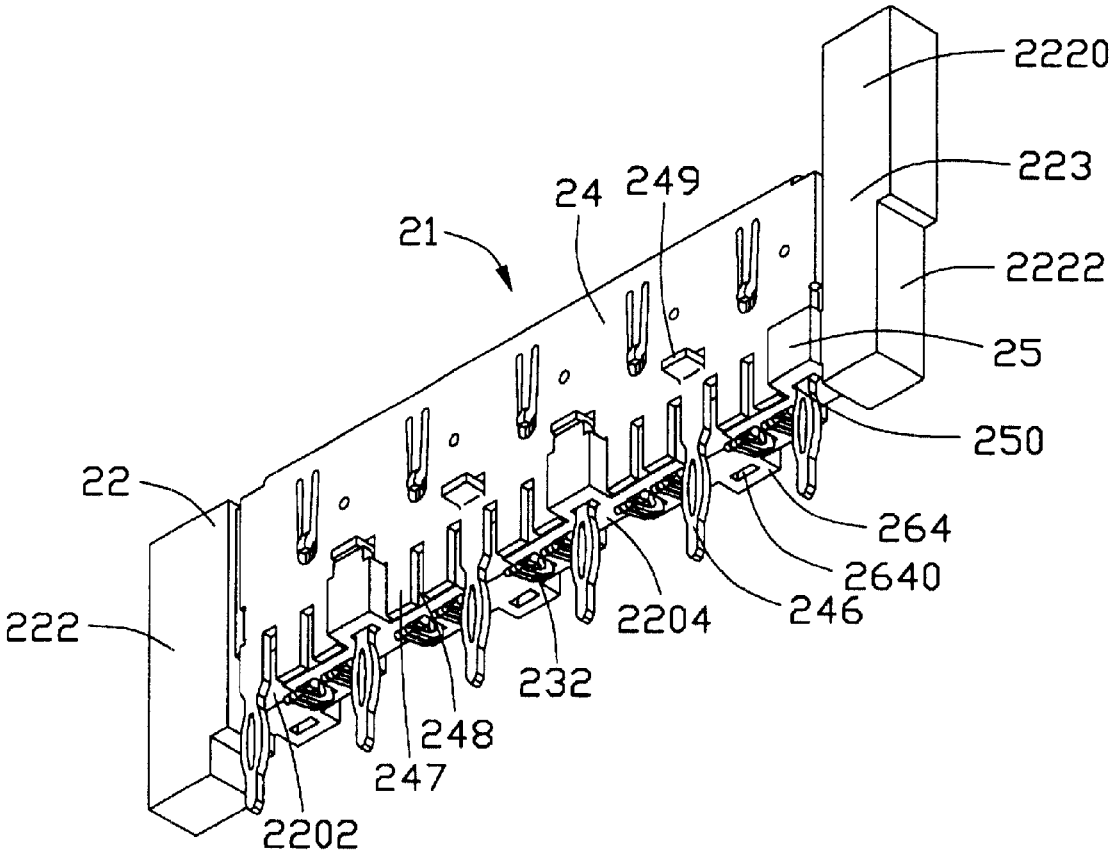
FIG. 4 is a perspective view of a wafer for constituting the electrical connector of the present invention.
Figure 5:
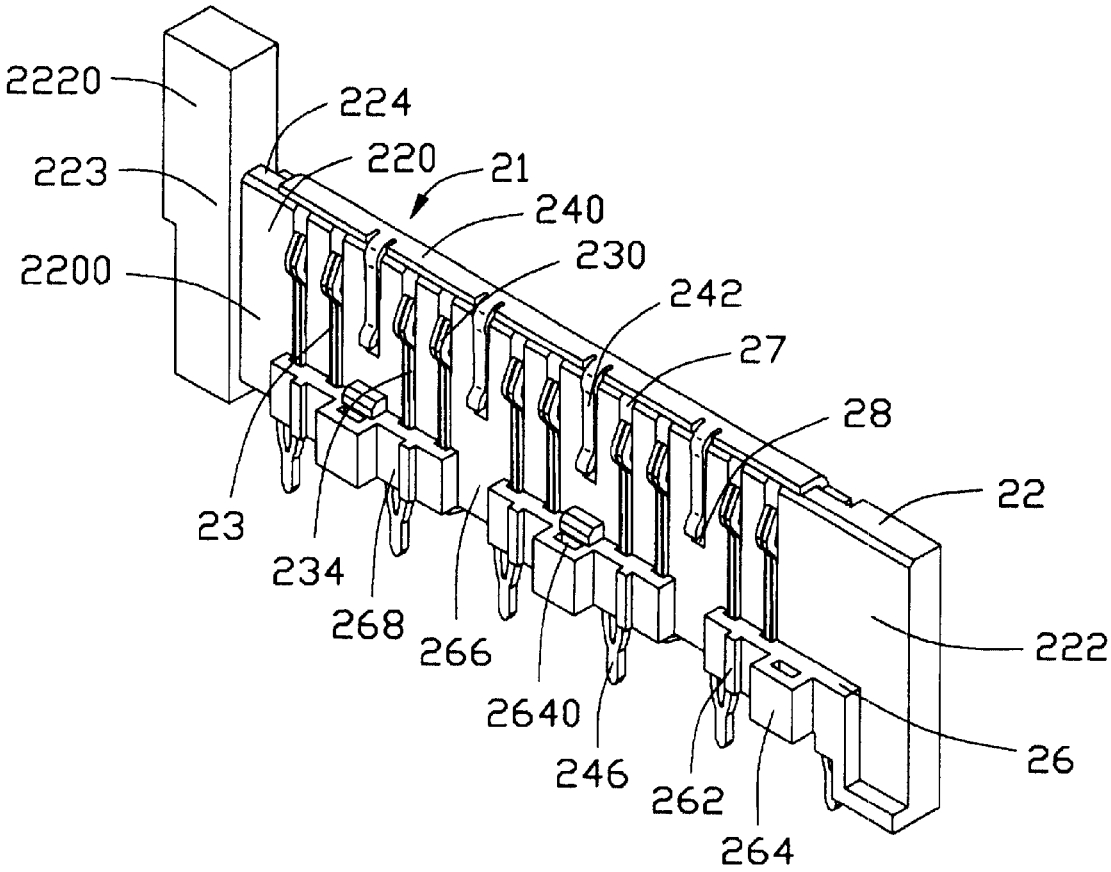
FIG. 5 is a view similar to FIG. 4 but from another aspect.
Figure 6:
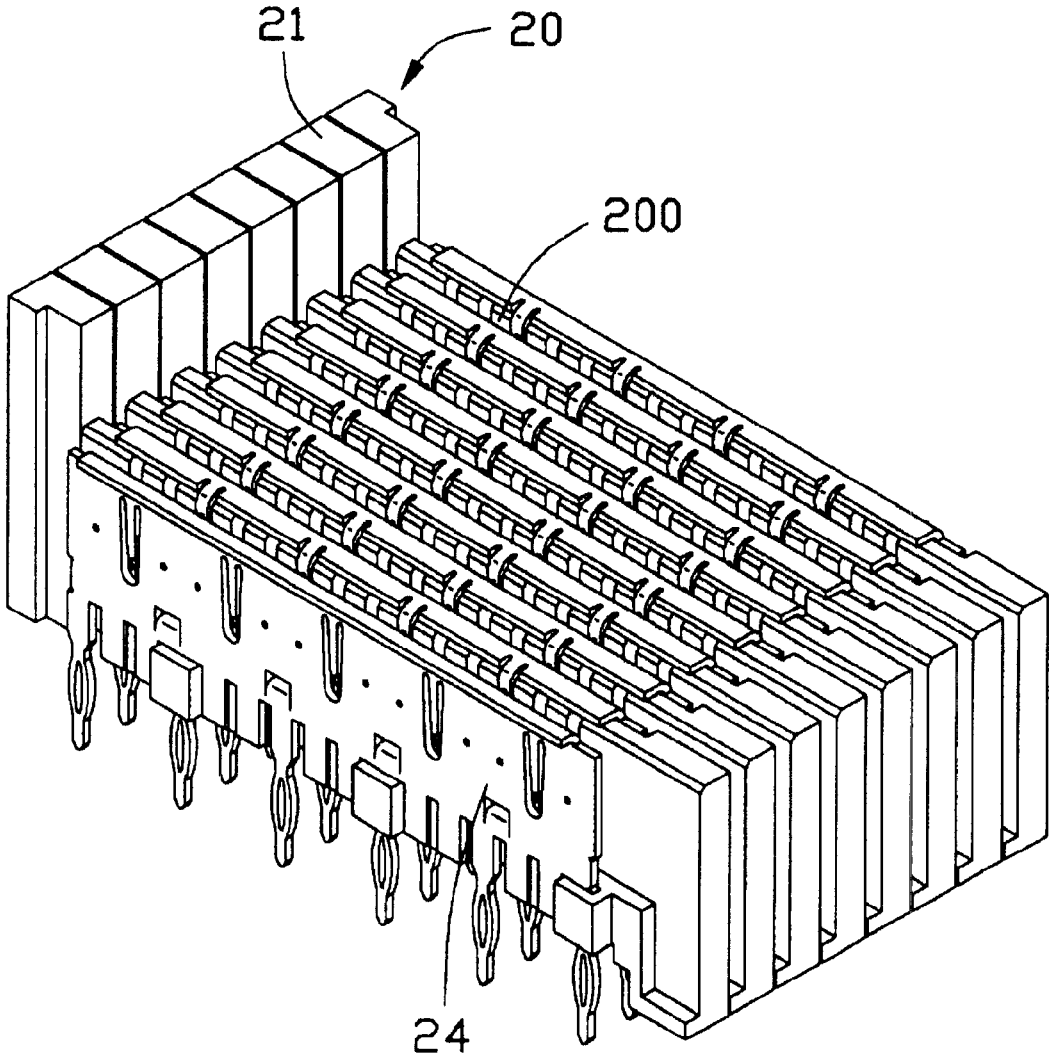
FIG. 6 is a perspective view of a spacer in accordance with the present invention.

The spacer 20 consists of a plurality of identical wafers 21. One of the wafers 21 is shown in FIGS. 4 and 5. The wafer 21 includes a dielectric base 22 and a plurality of signal terminals 23 and a grounding bus 24 respectively mounted on opposite sides of the dielectric base 22. The dielectric base 22 has a body portion 220, a front end portion 222 and a rear end portion 223. The rear end portion 223 has a top portion projecting upwardly beyond a top edge 224 of the body portion 220 thereby forming a shoulder 2220. The rear end portion 223 further defines a depression 2222 in a rear side thereof.

The body portion 220 of the dielectric base 22 has substantially side surfaces 2200, 2202, and a plurality of first and second blocks 25, 26 respectively projects from the side surfaces 2202, 2200. The first and second blocks 25, 26 are located adjacent to a bottom surface 2204 of the body portion 220 in a staggered manner, and bottom surfaces of the first and the second blocks 25, 26 are flush with the bottom surface 2204 of the body portion 220. Each second block 26 includes one or two ribs 262, and an embossment 264 located between the ribs 262. The side surface 2200 defines a plurality of channels 27 extending through the second blocks 26 to thereby running through a whole height of the body portion 220. The side surface 2200 of the body portion 220 also defines a plurality of recesses 28 from the top edge 224 of the body portion 220 between every two channels 27, but the recesses 28 are not throughout the body portion 220.

In assembly, the wafers 21 are assembled together to form the spacer 20. A plurality of parallel slots 200 is defined between adjacent wafers 21 for receiving the circuit boards 30 therein. When assembling, the shoulders 2220 of the wafers 21 are aligned with each other, and the first blocks 25 of each wafer 21 have an interferential fit with corresponding recesses 266 formed between the second blocks 26 and the rear end portion 223 of an adjacent wafer 21.

Subsequently, the plurality of signal terminals 23 and the grounding buses 24 are assembled onto the spacer 20 to thereby make each wafer 21 with the signal terminals 23 received in the channels 27 in the side surface 2200, and with the grounding bus 24 disposed on the side surface 2202 of the wafer 21. Each channel 27 receives a pair of signal terminals 23 therein. The signal terminals 23 are stamped from a single piece of metal sheet. Each signal terminal 23 includes a curved contacting portion 230 raised outside of the side surface 2200 of the dielectric base 22 for contacting with the signal traces of an inserted circuit board 30, a bent tail portion 232 extending toward the side surface 2202 of the dielectric base 22, and an intermediate portion 234 interconnecting the contacting portion 230 with the bent tail portion 232. There exists a clearance (not labeled) between the bent tail portion 232 and the bottom surface 2204 of the dielectric base 22, whereby the bent tail portion 232 can resiliently engage with the daughter board 50 when the electrical connector 1 is mounted to the daughter board 50.

Figure 7:
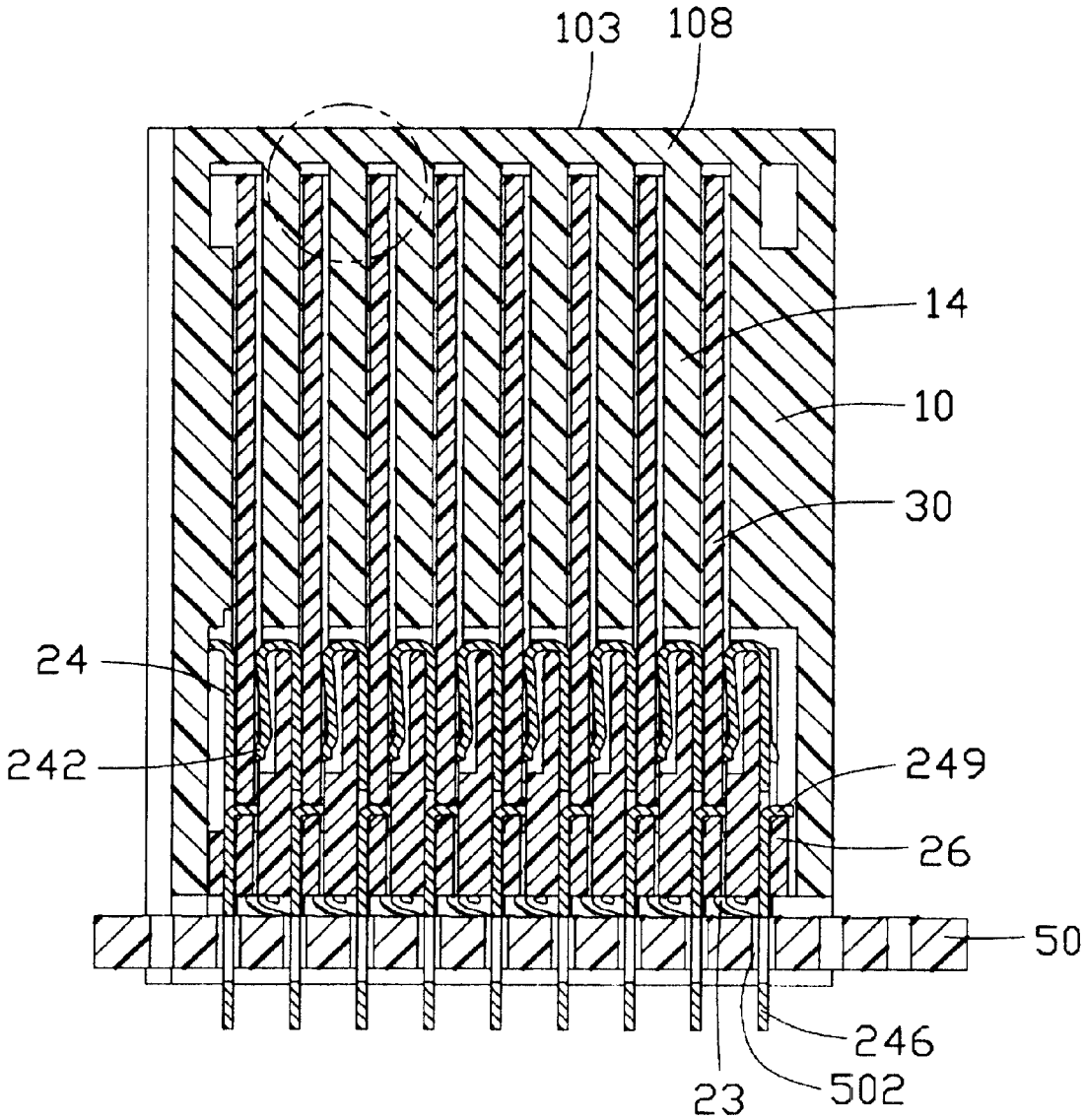
FIG. 7 is a cross-sectional view taken along line 7—7 of FIG. 1.
Figure 8:
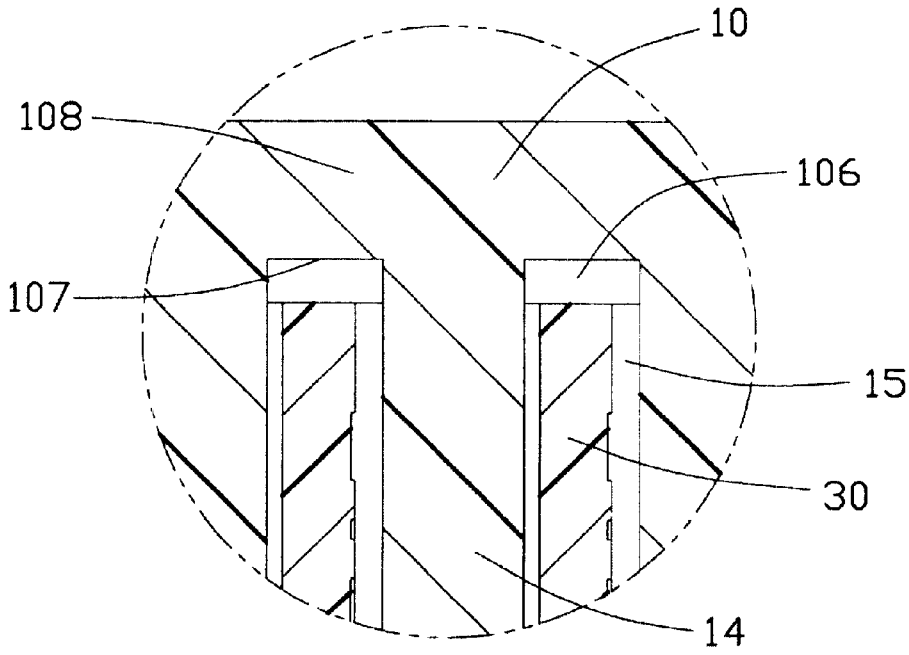
FIG. 8 is an enlarged view of a circled portion of FIG. 7.
Figure 9:
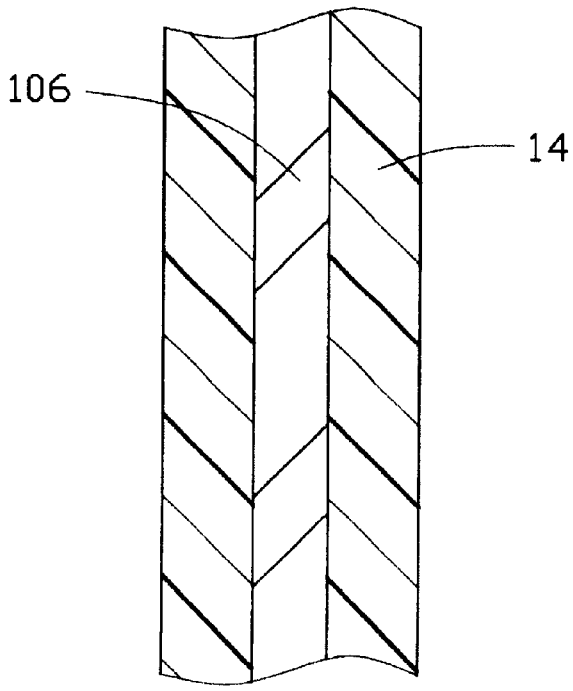
FIG. 9 is a portion of a cross-sectional view taken along line 9—9 of FIG. 3 in an enlarged scale.
Figure 10:
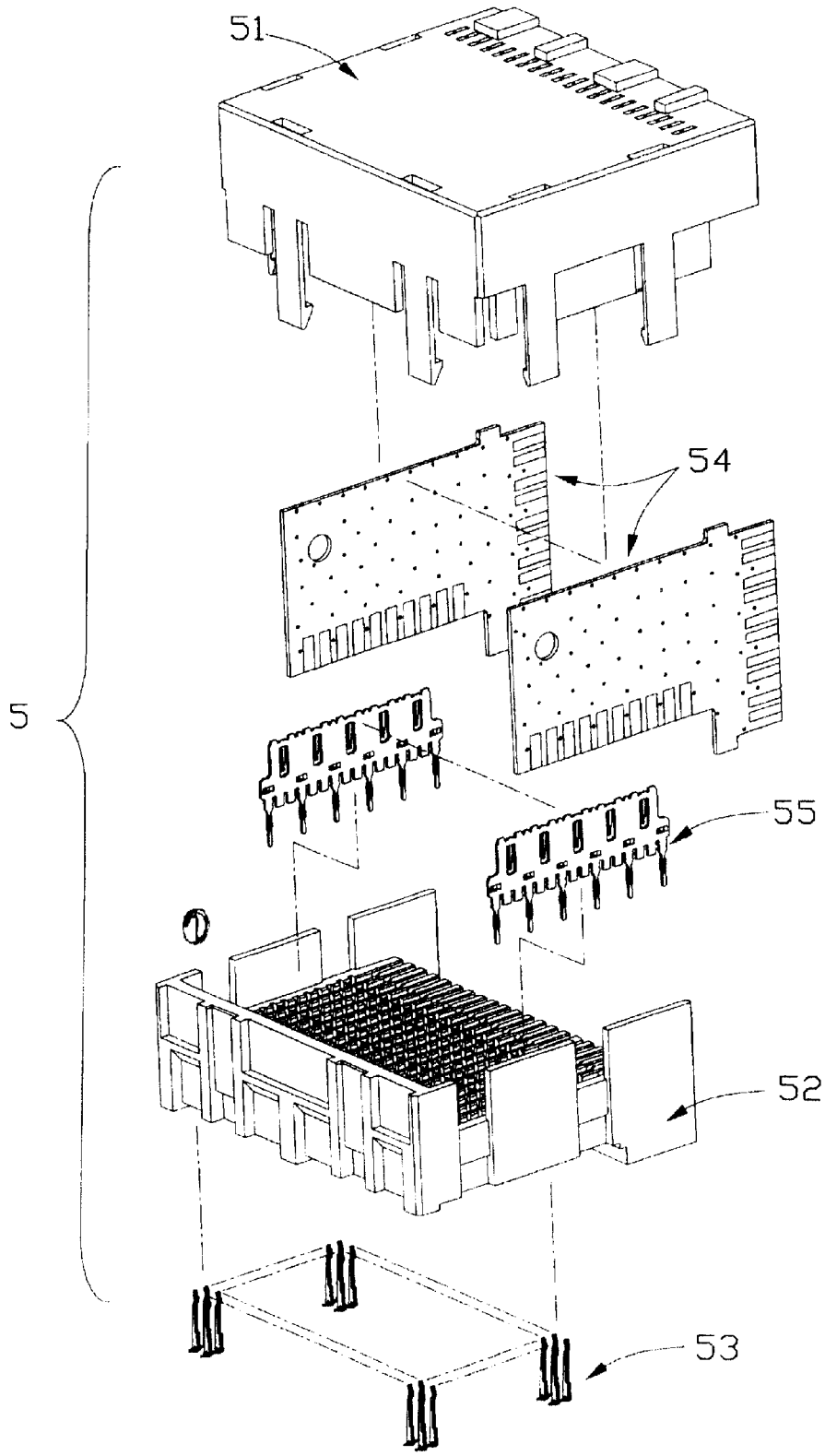
FIG. 10 is an exploded, perspective view of an electrical connector in accordance with a second embodiment of the present invention.
Figure 11:
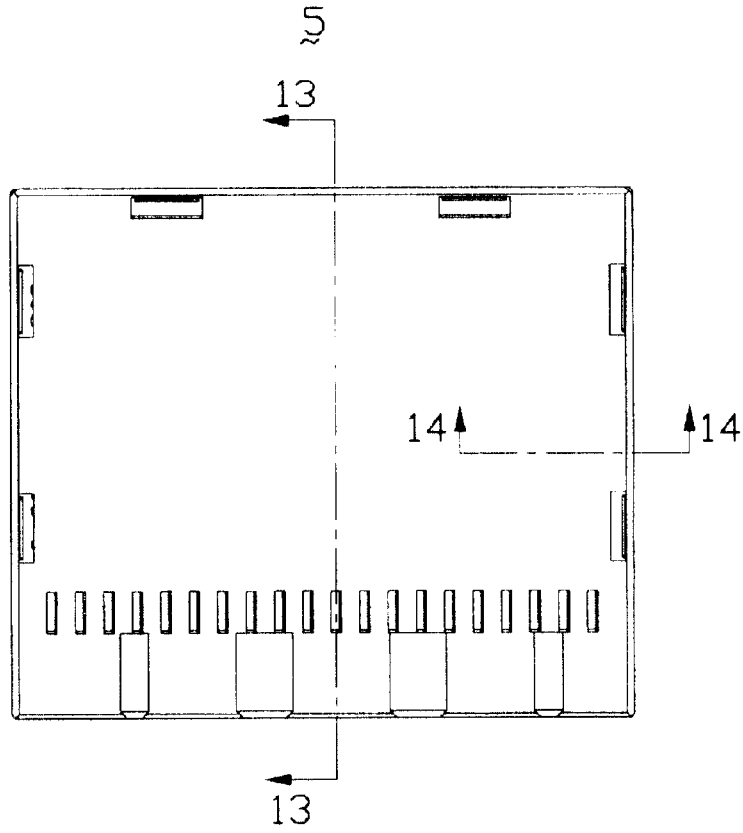
FIG. 11 is a top, assembled view of the electrical connector in FIG. 10.
Figure 12:
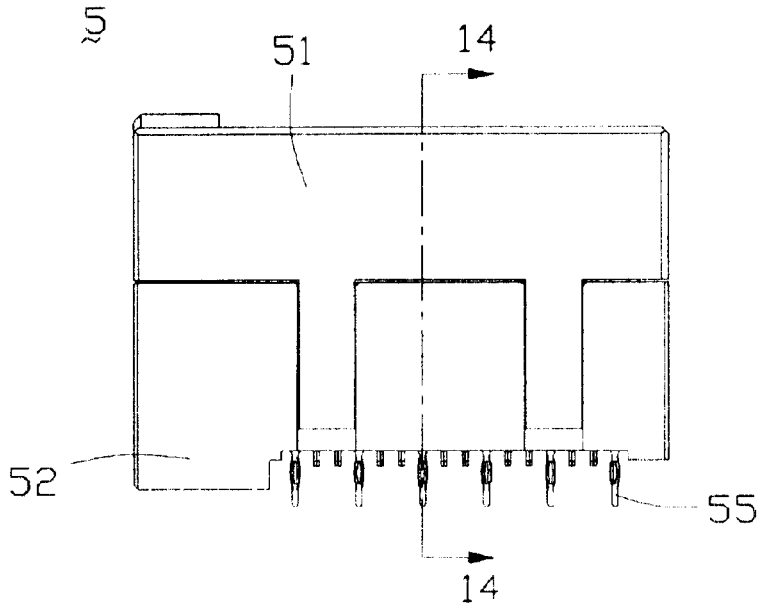
FIG. 12 is a side, assembled view of the electrical connector in FIG. 10.
Figure 13:
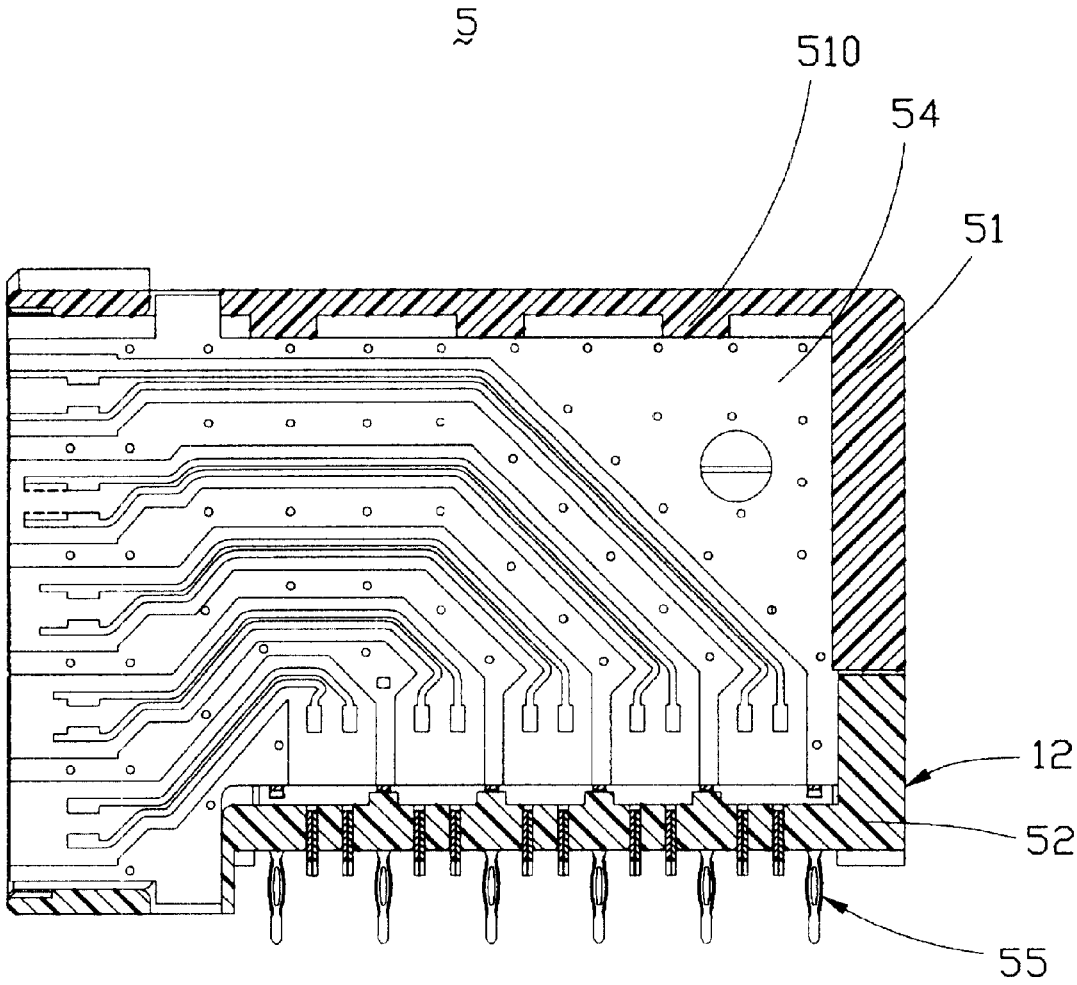
FIG. 13 is a cross-sectional view taken along line 13—13 of FIG. 11.
Figure 14:
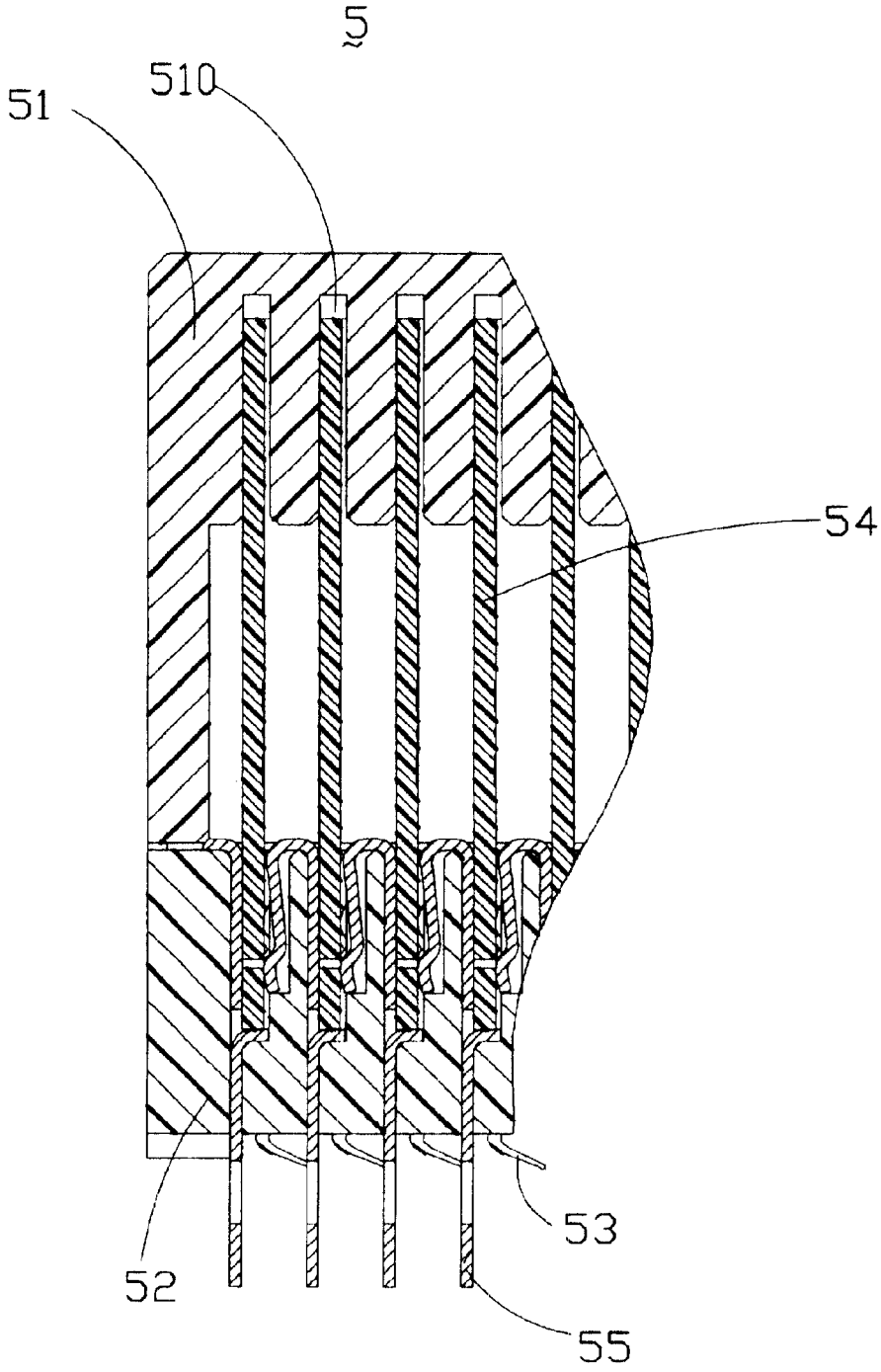
FIG. 14 is a cross-sectional view taken along line 14—14 of FIG. 12.

The grounding bus 24 is formed as a single piece snugly bearing against the side surface 2202 of the corresponding dielectric base 22. The grounding bus 24 has a top flange 240 covering the top edge 224 of the body portion 220, and a plurality of contacting legs 242 depending downwardly from the top flange 240 to be aligned with the recesses 28 of the dielectric base 22. A top end of each contacting leg 242 and the top flange 240 opposite to the contacting legs 242 respectively functions as a lead-in for facilitating insertion of the circuit board 30 into a corresponding slot 200. In addition, the grounding bus 24 has press-fit tails 246 for fittingly engaging with plated holes 502 (FIG. 7) of the daughter board 50. The tails 246 have a number which is the same as a total number of the first and the second blocks 25, 26 of the wafer 21. The grounding bus 24 also has several flaps 247 and slots 248 formed between two adjacent press-fit tails 246. The press-fit tails 246 extend beyond the bottom surface 2204 of the dielectric base 22 through apertures 250, 2640 respectively defined in the first blocks 25 and the second blocks 26. The flaps 247 of the grounding bus 24 are received in recesses 268 in the second blocks 26 of an adjacent wafer 21. Thus, the flaps 247 are disposed between the signal terminals 23 mounted on the two adjacent wafers 21 for functioning as a shell near lower ends of the signal terminals 23. The ribs 262 of the second blocks 26 of each wafer 21 are received in some of the slots 248 of an adjacent wafer 21. Furthermore, the grounding bus 24 defines a plurality of supporting pads 249 projecting opposite to the side surface 2202 of the wafer 21.

Referring to FIGS. 7–10, the housing 10 defines a plurality of bumps 106 extending downward from a bottom face 107 of an upper wall 108 of the housing 10 into the channels 15. The bumps 106 in a common channel 15 are parallel to each other and are inclined 45 degrees relative to the mating direction of the electrical connector 1.

After the spacer 20 is formed, the circuit boards 30 are respectively inserted into the slots 200 formed between the wafers 21. Each circuit board 30 is received in a corresponding slot 200 and electrically engages with the signal terminals 23 and the grounding bus 24 of the wafer 21. The contacting portions 230 of the signal terminals 23 electrically contact with the signal traces on the circuit board 30, and the contacting legs 242 of the grounding bus 24 electrically contact with the grounding traces on the circuit board 30. A rear edge 304 of each circuit board 30 abuts against the shoulder 2220 of a corresponding dielectric base 22.

The spacer 20 with the parallel circuit boards 30 received therein is then attached to the dielectric housing 10 in a back-to-front direction. The spacer 20 is received in the recess 13 of the housing 10. The channels 15 of the housing 10 guide the circuit boards 30 into the mating port 12 of the housing 10. Finally, the fastening element 40 is attached to the housing 10 for fixing the spacer 20 with the housing 10. The fastening element 40 includes a rear wall 400 covering the rear surface 102 of the housing 10, and a pair of latches 402 forwardly extending from opposite side edges of the rear wall 400. The latches 402 are received in the grooves 16 of the housing 10. The rear wall 400 has a protrusion 406 on an inner surface thereof for fitting into the depressions 2222 of the rear end portions 223 of the dielectric bases 22 of the wafers 21 and abutting against the rear end portions 223, whereby the housing 10 and the spacer 20 are securely connected with each other. Specially, the circuit boards 30 are held in position by the bumps 106 and the supporting pads 249 in vertical direction, wherein the supporting pads 249 in a common slot 200 are located alternately on the first blocks 25 and the second blocks 26 of a corresponding wafer 21 and a neighboring wafer 21, respectively. Meantime, the circuit boards 30 are also held in position by the contacting legs 242 and the contacting portions 230 of the signal terminals 23 of the corresponding wafer 21 and the grounding bus 24 of the neighboring wafer 21 in horizontal direction. Therefore, a reliable positioning mechanism for the circuit boards is obtained, which permits the circuit boards to be securely positioned in the electrical connector 1.

A cylinder pin 60 is inserted into through holes 32 of the circuit boards 30 through the aperture 17 of the housing 10 for keeping the circuit boards 30 in their original position rather than being pushed back when the electrical connector 1 mates with the complementary connector.

Furthermore, when the electrical connector 1 is mounted onto the daughter board 50, an external tool is used to apply a downward inserting force on the top surface 103 of the connector 1. The force is then transferred by the bumps 106 to the circuit boards and then to the supporting pads 249 of the grounding buses 24. The press-fit type tails 246 of the grounding buses are forced by the inserting force to be fitted in the plated holes 502 of the daughter board 50. Therefore, the bent tail portion 232 of each signal terminal 23 is then deflected to resiliently engage the corresponding signal trace on the daughter board 50.

FIGS. 10–14 show an electrical connector 50 in accordance with a second embodiment of the present invention. The electrical connector 50 includes a dielectric housing 51, an integral spacer 52 assembled to the dielectric housing 51, a plurality of circuit boards 54 retained between the dielectric housing 51 and the spacer 52, and a plurality of grounding buses 55 and terminals 53 assembled into the spacer 52. The dielectric housing 51 forms a plurality of bumps 510 extending downwardly from an inner surface thereof for transferred an external downward force to the circuit board 54.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the wafers one by one fastened by the grounding buses may be integrally formed as a one piece lower housing with a plurality of parallel slots therein for receiving the corresponding circuit boards 30, respectively.

What is claimed is:

1. An electrical connector comprising:

a dielectric housing comprising a first housing and a second housing assembled to the first housing, the first housing forming a plurality of ribs defining parallel channels therebetween, the channels extending in a mating direction of the electrical connector, a plurality of bumps extending downward from an upper wall of the dielectric housing in a vertical alignment with each channel;

a spacer assembled in the housing and including a plurality of wafers, each wafer having a dielectric base, a plurality of terminals attached on a side of the dielectric base and a grounding bus mainly attached on the other side of the dielectric base; and a plurality of circuit boards mounted between two adjacent wafers and an upper face of each circuit board abutting against a corresponding bump, said each circuit board electrically connecting with the terminals and the grounding bus;

wherein the bump in each channel is inclined 45 degrees relative to the mating direction of the electrical connector;

wherein the grounding bus has a contacting leg extending to the side of the dielectric base on which the terminals are attached.

2. An electrical connector comprising:

a dielectric housing forming a channel along a mating direction of the connector, said dielectric housing further forming a bump in the channel;

a plurality of wafers received in the housing and every two wafers defining a slot therebetween, each wafer having a dielectric base, a terminal and a grounding bus disposed on the dielectric base, said grounding bus defining a supporting pad facing the bump of the housing in a first direction; and a circuit board received in the channel of the dielectric housing and the slot to electrically connecting with the terminal and the grounding bus on a corresponding wafer, the circuit board being held in position in a second direction by the terminal and grounding bus of the corresponding wafer and the other wafer, said second direction being perpendicular to the first direction, and being held in the position in the first direction between the bump and the supporting pad of the grounding bus of the corresponding wafer;

wherein the bump extends downwardly from a bottom face of an upper surface wall of the dielectric housing;

wherein a contacting leg extends from the grounding bus of the corresponding wafer and engages with one side of the circuit board, and the other side of the circuit board engages with the grounding bus of the other wafer;

further having a fastening element covering a back of the housing to enclose the circuit board therein.

* * * * *